United States Patent [19]

Russell et al.

[11] 4,450,363

[45] May 22, 1984

[54] COORDINATED CONTROL TECHNIQUE AND ARRANGEMENT FOR STEAM POWER GENERATING SYSTEM

[75] Inventors: Thomas D. Russell, Montville; Robert R. Walker, Euclid, both of Ohio

[73] Assignee: The Babcock & Wilcox Company, New Orleans, La.

[21] Appl. No.: 375,798

[22] Filed: May 7, 1982

[51] Int. Cl.[3] ..... F01K 13/02

[52] U.S. Cl. ..... 290/40 C; 290/40 R

[58] Field of Search ..... 290/40 C, 40 R

[56] References Cited

U.S. PATENT DOCUMENTS

| | | | |
|---|---|---|---|
| 4,117,344 | 9/1978 | Boerstler et al. | 290/40 C X |
| 4,287,429 | 9/1981 | Bashnin et al. | 290/40 C |
| 4,287,430 | 9/1981 | Guido | 290/40 C |

*Primary Examiner*—G. Z. Rubinson
*Assistant Examiner*—W. E. Duncanson, Jr.
*Attorney, Agent, or Firm*—Vytas R. Matas; Robert J. Edwards

[57] ABSTRACT

A coordinated control technique and arrangement for a steam power generating system is disclosed in which combined megawatt error and turbine pressure error signal are used to control the turbine control valve and the fuel flow to the boiler.

3 Claims, 2 Drawing Figures

COORDINATED CONTROL TECHNIQUE AND ARRANGEMENT FOR STEAM POWER GENERATING SYSTEMcl FIELD AND BACKGROUND OF THE INVENTION

The present invention relates, in general, to the operation of steam turbines and boilers in electric power plants and, more particularly, to a new and useful coordinated control technique and arrangement for regulating steam turbine and boiler operation.

Generally, as applied to a boiler-turbine-generator, control systems in an electric power plant perform several basic functions. Three of the most important known systems of control have been characterized as the so-called boiler-following, turbine-following and integrated control systems.

In a turbine-following control mode, with increasing megawatt load demand, a megawatt load control signal increases the boiler firing rate and a throttle pressure control signal opens the turbine valves, which admit steam to the turbine, to a wider position to maintain a constant throttle pressure. The reverse occurs upon decreasing megawatt load demand. This type of arrangement provides a slow load response.

In a boiler-following control mode, the megawatt load control signal directly repositions the turbine control valves following a load change and the boiler firing rate is influenced by the throttle pressure signal. This system provides a rapid load response but less stable throttle-pressure control in comparison to the turbine-following control mode.

The integrated control system represents a control strategy where the load demand is applied to both the boiler and turbine simultaneously. This utilizes the advantages of both boiler and turbine following modes. In the integrated control system the load demand is used as a feedforward to both the boiler and turbine. These feedforward signals are then trimmed by any error that exists in the throttle pressure and the megawatt output.

A detailed introduction to controls for steam power plants and the characteristics of the boiler-following, turbine-following and integrated control systems may be found in the text *Steam/its generation and use,* 38th edition, Chapter 35, by the Babcock & Wilcox Company, New York, N.Y. 1972, and said chapter 35 is hereby incorporated by reference.

SUMMARY OF THE INVENTION

In accordance with the invention, a method of operating an electric power generation system, the system being of the type having an electric generator, a steam turbine connected to the electric generator a steam generator for supplying steam to the turbine, a flow line interconnected between the steam generator and the turbine for the passage of steam, throttle valve means in the flow line for regulating the turbine throttle pressure, and fuel flow regulating means for regulating heat input to the steam generator, is provided. The method includes the steps of producing a feed forward based on load demand, developing a throttle pressure error signal representative of the differences between measured throttle pressure signal and a throttle pressure set point, measuring the electrical load output of the electric generator, developing a megawatt error signal representative of the differences between the measured electrical output signal and the required electrical output, and, under transient operation, combining the throttle pressure signal and the megawatt error signal to produce (1) a first combined signal corresponding to the difference of the megawatt error signal and the throttle pressure error signal, and biasing the throttle valve controls by means responsive to the first combined signal, and (2) a second combined signal corresponding to the sum of the megawatt error signal and the throttle pressure error signal, and biasing the fuel flow control by means responsive to the second combined signal.

In accordance with a further feature of the inventive technique, during steady state operation, the throttle valve means is operated responsive to the throttle pressure error signal and the fuel flow regulating means is operated responsive to the megawatt error signal.

In accordance with a further feature of the invention, there is provided in a power generation system of the type having an electric generator, a steam turbine connected to the electric generator, a steam generator for supplying steam to the turbine, a flow line interconnected between the steam generator and the turbine for the passage of steam, throttle valve means in the flow line for regulating turbine throttle pressure, and fuel flow regulating means for regulating heat input to the steam generator, the combination comprising means producing a feed forward to the turbine based on load demand and for measuring throttle pressure, means for developing a throttle pressure error signal representative of the difference beween the measured throttle pressure and signal and a throttle pressure setpoint, means for measuring the electrical load output of the electric generator, means for producing a feed forward to the boiler based on load demand, means for developing a megawatt error signal representative of the difference between the measured electrical output signal and the required electrical output, and means for combining the throttle pressure error signal and the megawatt error signal to produce (1) a first combined signal corresponding to the difference of the megawatt error signal and the throttle pressure error signal, the throttle valve means being operable responsive to the first combined signal, and (2) a second combined signal corresponding to the sum of the megawatt error signal and the throttle pressure error signal, and the fuel regulating means being operable responsive to the second combined signal, and selector means for selectively operating the combining means responsive to transient conditions.

For an understanding of the principles of the invention, reference is made to the following description of a typical embodiment thereof as illustrated in the accompanying drawings.

DETAILED DESCRIPTION

Figure 1:
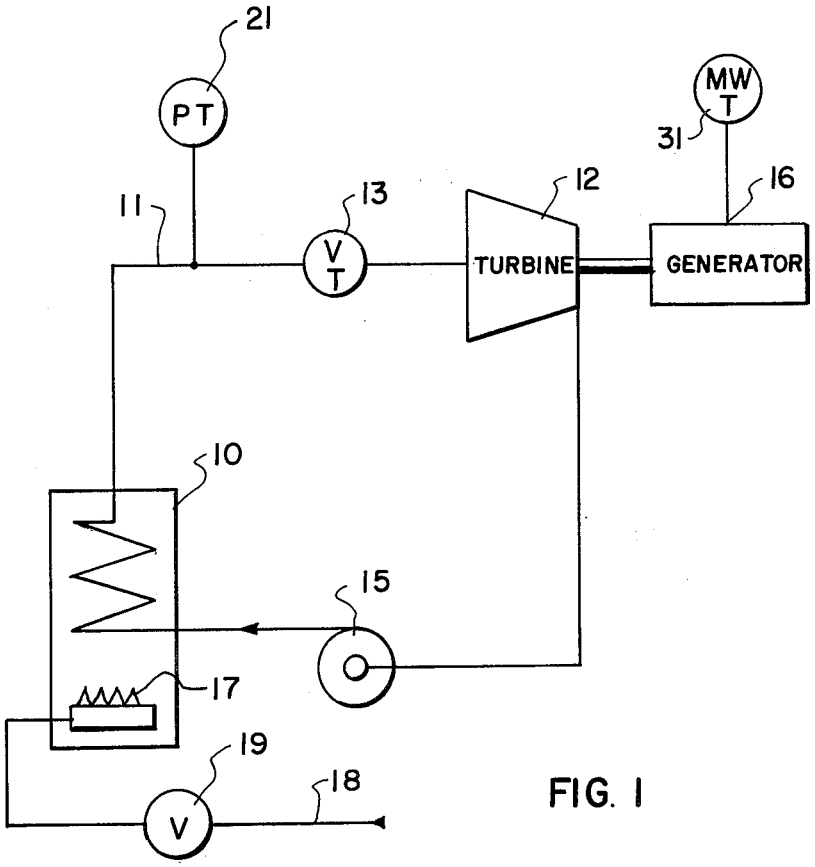
FIG. 1 is a schematic representation of a steamwater cycle and fuel cycle.

Referring now to the drawings, wherein like reference characters represent like or corresponding views throughout the several views, FIG. 1 schematically illustrates a well-known feedwater and steam cycle for an electric power plant. Steam is generated in a fossil fuel-fired steam generator or boiler 10 and passed via a conduit 11 to a turbine 12 through a turbine control valve 13, only one of which is shown, in the conduit 11. The steam is discharged from the turbine to a condenser where it is condensed, and then pumped by a boiler feed pump 15 to the steam generator 10 to complete the cylce. Those skilled in the art will appreciate that numerous components are not shown in the schematic representation, or example, condensate pumps, feedwater heaters, water treatment devices, steam reheater, instrumentation and controls, and the like as such are not necessary for a schematic representation of the steam-feedwater cycle. The turbine 12 is mechanically coupled to and drives an electric generator 16 to provide electric energy to a distribution system (not shown).

The heat input to the steam generator 10 is schematically indicated by flames 17 which are fueled by a fuel supply typically fed through a fuel feed line 18 and controlled schematically shown by a valve 19. An air supply (not shown) is also injected to effect combustion of the fuel. A more detailed description of steam-water and fuel-air cycles for power producing units, and control systems therefor, are generally known, for example, see U.S. Pat. No. 3,894,396 which is hereby incorporated by reference.

Figure 2:
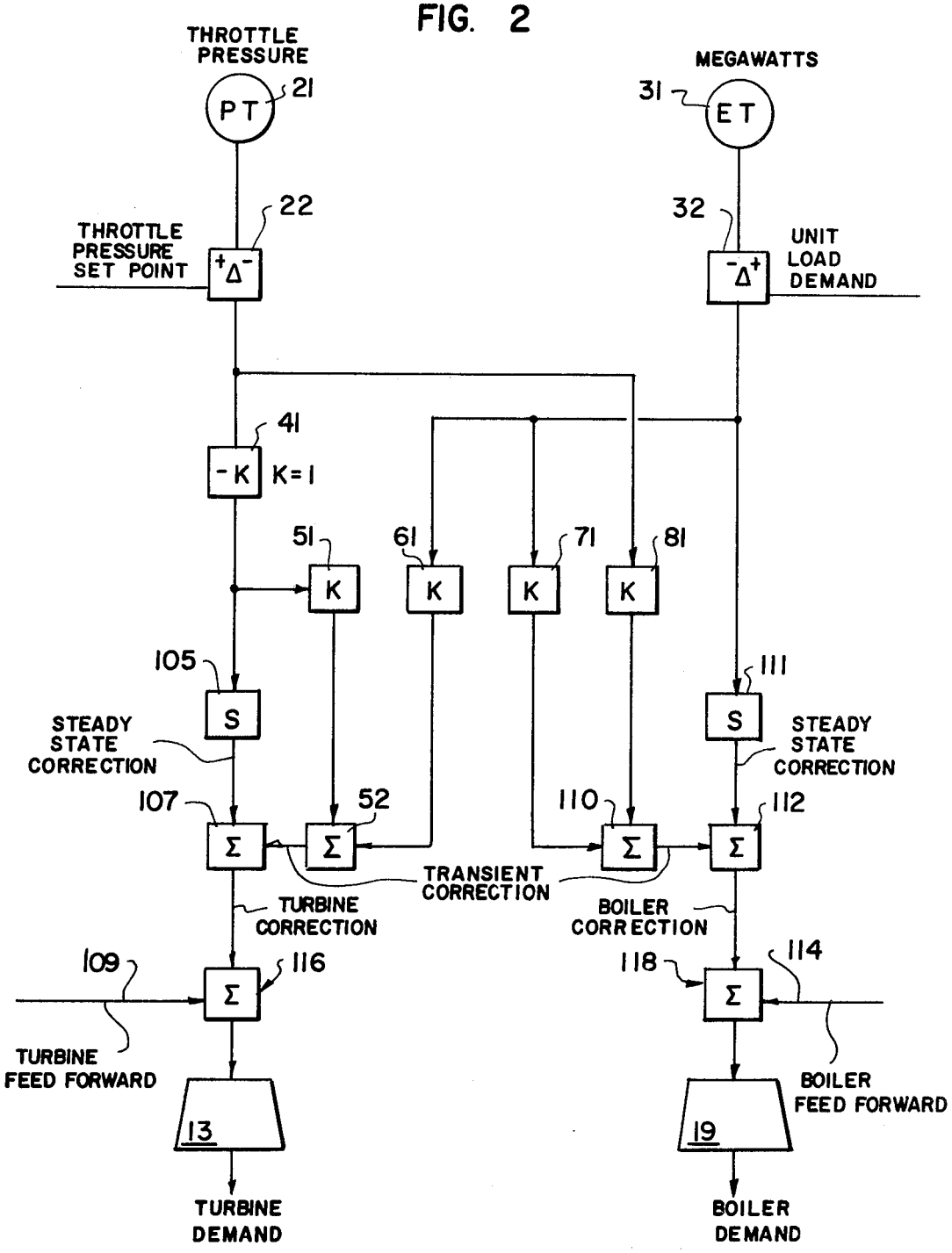
FIG. 2 is a logic diagram of a control system embodying the invention as applied to a typical steam generating system as shown in FIG. 1.

FIG. 2 is a logic diagram of sub-loops of a control system embodying the invention as applied to the power production system of FIG. 1. In FIG. 2, the modifying signals, one or more of which are applied to each discrete control loop, are identified as a megawatt error signal ($MW_e$), a throttle pressure error signal ($TP_e$), and a first combined signal ($MW_e+TP_e$) and a second combined signal [$MW_e+(-TP_e)$] both combined signals being adapted for transient correction as discussed hereafter.

In reference to the drawings, it should be noted that conventional control logic symbols have been used. The control components, or hardware, as it is sometimes called, which such symbols represent, are commercially available and their operation well understood. Further, conventional logic symbols have been used to avoid identification of the control system with a particular type of control such as pneumatic, hydraulic, electronic, electric, digital or a combination of these, as the invention may be incorporated in any one of these types. Further to be noted, the primary controllers shown in the logic diagrams have been referenced into FIG. 1 as have the final control elements.

In FIG. 2, a throttle pressure transmitter 21 generates a signal which is a measure of the actual throttle pressure. The throttle pressure signal is transmitted over a signal conductor to a difference unit 22 in which it is compared to a set point signal. The difference unit 22 produces an output signal corresponding to the throttle pressure error signal ($TP_e$).

The megawatt error signal ($MW_e$) is generated by comparing the output signal generated in a megawatt transmitter 31 with the unit load demand in a difference unit 32.

The error signal $TP_e$ and $MW_e$ are applied to computing units in the discrete control loops of FIG. 2. As described hereinafter, the particular error signals applied to make a steady state and/or applied to make a transient state adjustment to the turbine and/or boilder load demands, as calculated by their respective feed forwards, are dependent upon the discreet control loop utilized.

The throttle pressure error signal (TPe) from difference unit 22 is directed to an inverting unit 41. The action of the throttle pressure error is different for the boiler and turbine, low throttle pressure requires a decreasing signal to the turbine valve controls and an increasing signal to the boiler fuel flow control. The inverted throttle pressure error signal is forwarded through a signal conductor to a proportional unit 51 and an integral unit 105, described hereinafter. The throttle pressure error (TPe) signal (non-inverted) is also sent to a proportional unit 81. The megawatt error signal (MWe) from difference unit 32 is directed through a signal conductor to a proportional unit 61, to another proportional unit 71, and to an integral unit 111, described hereinafter.

The correction or bias to the turbine feedforward signal 109 consists of two parts, a steady state correction and a transient correction. The steady state correction is calculated by applying the inverted throttle pressure error from inverter 41 to an integral unit 105. The output of the integral unit 105 is summed with the transient correction in summer 107. When conditions permit the steady state correction, output of integral 105, to be adjusted, the integral 105 is released to respond to the inverted throttle pressure error signal. When conditions warrant, such as during rapid load changes, the integral 105 is blocked, thus its output to summer 107 is held constant. The transient correction to the turbine feedforward signal 109, is the sum of the properly gained inverted throttle pressure error (TPe) and megawatt error (MWe). The inverted throttle pressure error is forwarded through a signal conductor to a proportional unit 51. The megawatt error signal is forwarded through a signal conductor to a proportional unit 61. The output from these proportional units 51 and 61 are totalled by a summer unit 52. The output of summer 52 is the transient correction. Summer unit 107 combines the steady correction from integral unit 105 and the transient correction from summer unit 52 to generate the turbine correction signal. The turbine correction signal is then added to the turbine feedforward signal 109 in summer unit 116 to develop the turbine demand signal 13.

The correction or bias to the boiler feedforward signal 114 consists of two parts, a steady state correction, and a transient correction. The steady state correction is calculated by applying the megawatt error signal (MWe) from difference unit 32 to an integral unit 111. The output of the integral unit 111 is summed with the transient correction in summer 112. When conditions permit the steady state correction to be adjusted, the integral 111 is released to respond to the megawatt error signal (MWe). When conditions warrant, such as during rapid load changes, the integral unit 111 is blocked, thus its output, steady state correction, to summer unit 112 is held constant. The transient correction to the boiler feedforward signal 114 is the sum of the properly gained throttle pressure error (TPe) and megawatt error (MWe). The throttle pressure error (TPe) is forwarded through a signal conductor to a proportional unit 81. The megawatt error (MWe) is forwarded through a signal conductor to a proportional unit 71. The output from these proportional units 71 and 81 are totalled by summer unit 110. The output of summer unit 110 is the transient correction to the boiler. Summer unit 112 combines the steady state correction from integral unit 111, and the transient correction from summer unit 110 to generate the boiler correction signal. The boiler correction signal from summer 112 is then added to the boiler feedforward, signal 114 in summer 118 to develop the boiler demand signal 19.

The control coordination system and techniques developed herein uses a feedforward based on the load demand which is then corrected to develop a boiler demand for fuel flow resolution and a turbine demand regulation of the turbine valves. The boiler and turbine corrections are developed independently consisting of a steady state correction and a transient correction.

The fuel flow determines the megawatt output and, therefore, any steady state megawatt error can only be corrected by adjusting the fuel flow. So, the steady state correction for the boiler is derived from the megawatt error (MWe). In a similar manner, since the turbine can only affect throttle pressure, its steady state correction is based on the throttle pressure error (TPe).

The transient corrections are based on the desire to achieve maximum response to the unit. To achieve this the turbine controls are biased to make use of the boiler's energy storage capacity. However, the turbine cannot be permitted to overtax the boiler's capacity. To achieve this, megawatt error is used to bias the turbine control while being limited by the magnitude of the throttle pressure error. In short, the transient correction to the turbine is MWe−TPe. Even though we can momentarily vary the energy flow to the turbine by adjusting the turbine valves, it is only a short term solution. In the end, the firing rate must replace the borrowed energy and bring the unit to its new energy storage level. Throttle pressure error is an index of deviation from the desired energy storage level. Megawatt error (MWe) provides an index as to the magnitude of the load change, and is used to increase the over/under firing to assist in achieving the load change. Thus, MWe+TPe is used as the transient correction for the boile.

While a specific embodiment of the invention has been shown and described in detail to illustrate the application of the principles of the invention, it will be understood that the invention may be embodied otherwise without departing from such principles.

The controls described are for the integral mode of operation, it is recognized that the control strategy will change when the boiler and/or turbine is placed in manual. When this happens, the controls degrade to basic boiler following, turbine following, or separated modes of operation. These changes are not shown or discussed but would normally be provided with any system supplied.

We claim:

1. A method of operating an electric power generation system, the system being of the type having an electric generator, a steam turbine connected to the electric generator, a steam generator for supplying steam to the turbine, a flow line interconnected between the steam generator and the turbine for the passage of steam, throttle valve means in the flow line for regulating turbine throttle pressure, and fuel flow regulating means for regulating heat input to the steam generator, comprising the steps of measuring throttle pressure, producing a feed-forward proportional signal based on load demand for the turbine, developing a throttle pressure error signal representative of the difference between said measured throttle pressure signal and a throttle pressure setpoint, measuring electrical load output of the electric generator, producing a feedforward proportional signal based on load demand for the boiler, developing a megawatt error signal representative of the difference between said measuring electrical output signal and a unit load demand, and further comprising, during transient operation, combining said throttle pressure error signal and said megawatt error signal to produce (1) a first combined signal corresponding to the difference of said megawatt error signal and said throttle pressure error signal, and biasing the throttle valve controls by means responsive to said first combined signal, and (2) a second combined signal corresponding to the sum of said megawatt error signal and said throttle pressure error signal, and biasing the fuel flow control by means responsive to said second combined signal.

2. A method of operating an electric power generation system, as set forth in claim 1, further comprising, during steady state operation, biasing the throttle valve controls by means responsive to said throttle pressure error signal and operating the fuel flow controls by means responsive to the megawatt error signal.

3. In a power generation system of the type having an electric generator, a steam turbine connected to the electric generator, a steam generator for supplying steam to the turbine, a flow line interconnected between the steam generator and the turbine for the passage of steam, throttle valve means in the flow line for regulating turbine throttle pressure, and fuel flow regulating means for regulating heat input to the steam generator, the combination comprising means for measruing throttle pressure, producing a feedforward proportional signal based on load demand for the turbine, means for developing a throttle set point, means for measuring electrical load output of the electric generator, means for producing a feedforward proportional signal based on load demand for the boiler means for developing a megawatt error signal representative of the difference between said measured electrical output signal and the required electrical output, means for combining said throttle pressure signal and said megawatt error signal including first means for providing a signal corresponding to the difference of said megawatt error signal and said throttle pressure error signal for controlling said throttle valve means and second means for providing a signal corresponding to the sum of said megawatt error signal and said throttle pressure error signal, for controlling said fuel flow regulating means.

* * * * *